US008056144B2

(12) United States Patent
Gafforio et al.

(10) Patent No.: US 8,056,144 B2
(45) Date of Patent: Nov. 15, 2011

(54) SAFETY HELMET WITH SCREENING ELEMENT

(75) Inventors: Luca Gafforio, Comun Nuovo (IT); Alberto Salvetti, Bergamo (IT); Gabriele Tomasoni, Bariano (IT)

(73) Assignee: Opticos S.r.l., Brembate di Sopra (BG) (IT)

( * ) Notice: Subject to any disclaimer, the term of this patent is extended or adjusted under 35 U.S.C. 154(b) by 124 days.

(21) Appl. No.: 11/152,788

(22) Filed: Jun. 15, 2005

(65) Prior Publication Data

US 2005/0273912 A1 Dec. 15, 2005

(30) Foreign Application Priority Data

Jun. 15, 2004 (EP) ..... 04425443

(51) Int. Cl.
*A42B 3/22* (2006.01)

(52) U.S. Cl. ..... 2/6.4; 2/6.5; 2/10; 2/424

(58) Field of Classification Search ..... 2/425, 424, 2/10, 12, 410, 6.4, 6.5
See application file for complete search history.

(56) References Cited

U.S. PATENT DOCUMENTS

| | | | | |
|---|---|---|---|---|
| 3,636,565 | A * | 1/1972 | Luisada et al. | 2/410 |
| 4,689,836 | A * | 9/1987 | Vitaloni | 2/424 |
| 4,769,857 | A * | 9/1988 | Cianfanelli et al. | 2/424 |
| 5,113,535 | A | 5/1992 | Hedges et al. | |
| 6,282,726 | B1 * | 9/2001 | Noyerie et al. | 2/424 |
| 6,622,313 | B1 | 9/2003 | Choi et al. | |
| 2003/0182716 | A1 * | 10/2003 | Wu | 2/424 |

FOREIGN PATENT DOCUMENTS

| | | | |
|---|---|---|---|
| EP | 0 479 407 | | 4/1992 |
| EP | 0 590 255 | | 4/1994 |
| EP | 0 953 299 | | 11/1999 |
| EP | 1 323 361 | | 7/2003 |
| EP | 1 393 642 | | 3/2004 |
| FR | 2 501 478 | | 9/1982 |
| FR | 2 626 149 | | 7/1989 |
| GB | 2024927 | A * | 1/1980 |
| GB | 2 052 244 | | 1/1981 |
| GB | 2052244 | A * | 1/1981 |
| IT | 11 77 250 | | 8/1987 |

OTHER PUBLICATIONS

European Search Report for EP 04 42 5443 dated Nov. 9, 2004.

* cited by examiner

*Primary Examiner* — Shaun R Hurley
*Assistant Examiner* — Andrew Sutton
(74) *Attorney, Agent, or Firm* — Nixon & Vanderhye P.C.

(57) ABSTRACT

A safety helmet includes a cap equipped with at least one visor, which is hinged to the sides of the front opening of the cap itself and can be rotated between a position of interception of the front opening and a raised position with respect to the opening. A shielding element is also hinged to the sides of the front opening of the cap and is rotatable both with respect to the cap and with respect to the visor. The relative rotary displacement of the shielding element with respect to the visor, and vice versa, is limited at a predefined angular interval, in both of the directions of rotation.

18 Claims, 5 Drawing Sheets

SAFETY HELMET WITH SCREENING ELEMENT

This application is a new U.S. patent application and claims priority to EP 04425443.1, filed 15 Jun. 2004, the entire content of which is hereby incorporated by reference.

BACKGROUND OF THE INVENTION

The present invention relates to a safety helmet, in particular for motorcycling use, of the type comprising a visor hinged on the cap, to the sides of the front opening of the helmet, and a shielding element for protection from light rays or other atmospheric agents, such as for example rain, which is also hinged on the cap and movable with respect to the cap and the visor to enable alternatively its use or nonuse by a user according to the different environmental conditions that may be encountered when driving (daylight, darkness, tunnels, etc.).

It forms part of the known art to equip safety helmets for motorcyclists, as well as with the customary transparent visor, with a shielding element for protection against light rays which, constrained to the cap or to the visor, can be set so as to protect the user's eyes, in the case where the light rays disturb vision, or else can be set so as not to interfere with the field of vision of the user himself, should the luminosity be limited. Such a shielding element usually consists of an additional visor equipped with a transparent region with limited transmittance of light radiation, for example consisting of a filter for sunlight.

The Italian patent IT1.177.250, filed in the name of BMW, teaches making a safety helmet comprising a transparent visor, pivoted to the cap and designed to intercept the front opening of the helmet, and an anti-dazzle shielding element, which is also constrained to the cap of the helmet and set underneath the transparent visor. The shielding element, in particular, can be displaced between an operative position, in which the shielding element interferes at least partially with the front opening of the helmet, and an inoperative position, in which the shielding element is housed within a recess made on the cap itself, in such a way as not to interfere with the aforesaid front opening.

In this embodiment, as in other similar embodiments known to the art, the internal shielding element and the external transparent visor are actuated in a substantially separate way, so that rotation of the external visor does not affect the position reached by the shielding element, and vice versa. It may consequently occur that in conditions of sudden reduction of visibility, due also to accidental situations that could arise when travelling (such as, for example, the sudden formation of dirt on the top visor), the user instinctively opens the external visor, seeking to obtain a greater visibility, but in so doing the shielding element, which is independent of the main visor, will remain in the same position and will consequently prevent restoration of maximum visibility.

The European patent ER-A-0590255, filed in the name of the present applicant, describes a safety helmet for motorcycling use, in which an additional visor with low transmittance (i.e., designed to shield from light rays) is pivoted to the cap of the helmet underneath on external visor with high transmittance. Both of the visors are movable between a position of interception (either total or partial) of the front opening of the helmet, and a raised position, with respect to the front opening, in which both of the visors are housed in a seat provided inside the cap. The internal visor envisages an end-of-travel arrest for the top end of the external visor that enables fixed rotation of the two visors only when the latter are arranged in a given relative position.

Consequently, the two coupled visors are free to be displaced, at least in one direction of rotation, independently of one another, and hence they independently reach positions that, during use, can prove far from readily accessible or inconvenient to actuate by the user.

Thus, for example, in the set of visors described above, the raising of the external visor causes raising, in a position sensibly set back with respect to the front opening at the helmet., of the internal visor on the cap, whilst the subsequent actuation of the external visor engaged with the front opening of the helmet, for example thanks to a lead-in portion set in a position corresponding to the bottom area (closer to the front opening and readily accessible for the user) of the external visor, does not affect the retracted position reached by the internal visor with respect to the cap. This implies that the subsequent possible lowering of the internal visor, so that this intercepts the front opening of the helmet, prove considerably inconvenient for the user, who must identify and rotate the grip, or perform another actuation, of the internal visor set in a retracted position on the cap.

In addition, when both of the visors are arranged so as to intercept the front opening of the helmet, the raising of the internal visor, until it has reached its end-of-travel position, is not correlated mechanically to the raising of the external visor, and hence, when the user decides to raise the two visors from the front opening of the helmet, an erroneous actuation of just the internal shielding visor implies the necessary and inconvenient repetition of the action of raising directed, in this case, at the external visor.

The European patent application EP-A-1323361, filed in the name of HELM INTERNATIONAL, relates to a safety helmet equipped with an internal visor for shielding from sunlight and an external transparent visor, altogether similar to the helmet described in the patent EP-A-0590255, in which the two visors, in their raised position, are arranged above the outer surface of the cap. The helmet proposed by HELM INTERNATIONAL envisages means for limiting the travel of the two visors with respect to the cap, according to a predefined angle for each visor.

The British patent application GB-A-2052244, filed in the name of ROMER teaches providing a shielding element, or shielding visor, outside the transparent visor for interception of the front opening of the helmet. The relative motion between the two visors is adjusted by their geometrical and spatial conformation, there not being provided specific means for rendering rotation of the two visors fixed even in a given reciprocal position. The ROMER helmet envisages means for limiting the angle of rotation of the two visors with respect to the cap.

Both of the patents EP-A-1323361 and GB-A-2052244 present the same drawbacks described in relation to the European patent application EP-A-0590255.

Finally, in the case of the set of visors described in the ROMER patent, resting (not regulated by appropriate stops) of the bottom edge of the top shielding visor on the outer surface of the bottom transparent visor, can cause scratching or cracking of the latter.

Likewise known to the art is providing safety helmets for motorcyclists equipped with a flap connected to the cap and set in a position corresponding to the top edge of the front opening of the helmet. The flap, which extends above the transparent visor for interception of the front opening, is usually fixed with respect to the cap itself and has the function of sheltering the user from sunlight or from atmospheric agents, such as for example rain.

The French patent application FR2.501.478, filed in the name of Monin, teaches fixing a protective flap in an irremovable way above the front opening of the helmet and associating, in a rotatable way, a transparent visor to the protective flap. The absence of a rotatable visor constrained to the cap and the impossibility of removing, or at least, moving the protective flap away from the front opening renders the use of the helmet extremely inconvenient and far from functional. The European patent application EP-A-0479407, filed in the name of Shoei, describes a helmet equipped with a removable protective flap, constrained to the cap, set on top of a visor connected in a rotatable way to the cap itself.

The presence of a flap fixed to the cap that is placed on top of the visor of the helmet, in addition to causing a certain complexity of construction of the helmet itself, renders actuation of the visor by the user inconvenient, which can in fact be hindered by the flap.

In both of the cases referred to above, it happens moreover that the effectiveness of the shading from sunlight offered by the fixed flap is satisfactory only in certain conditions of exposure or at certain hours of the day and then becomes partially or to tally unsatisfactory at other moments or in other situations and forces the user to assume positions of his head aimed to seek the desired shade; in the case, moreover, of rays reflected by objects in the horizontal plane of travelling, shading is then totally absent.

SUMMARY OF THE INVENTION

A purpose of the present invention is to provide a safety helmet, preferably for motorcycling use, equipped with at least one transparent visor and at least one shielding element, which are pivoted to the sides of the front opening of the cap, the helmet being convenient to use and consequently not presenting the drawbacks described above.

Another purpose of the present invention is to guarantee that a safety helmet of the type referred to above will enable the user to obtain reduction of transparency and/or of luminosity of the field of vision only following upon a voluntary manoeuvre on his own part and that this will be possible only in certain given configurations of the product, whereas in all the other configurations this cannot occur.

Another purpose of the present invention is to provide a safety helmet of the type referred to above that is equipped with a certain degree of structural simplicity, capable of favouring the activity of assembly and maintenance of the set of visors associated thereto.

A further purpose of the present invention is to provide a set of visors for safety helmets of the type consisting of a transparent visor and a shielding element for protection against light rays or atmospheric agents, which will be easy to manufacture and simple to use.

The above and other purposes are achieved by the safety helmet described herein.

The safety helmet according to the present invention comprises a cap equipped with: at least one visor, which, according to the known art, is hinged to the sides of the front opening of the cap itself and can be rotated between a position of interception of the front opening and a raised position with respect to the opening; and a shielding element, which is also hinged to the sides of the front opening of the cap and is rotatable both with respect to the cap and with respect to the aforesaid visor. The helmet of the present invention likewise comprises first means for limiting, at a predefined angular interval, in both at the directions of rotation, the relative rotary displacement of the shielding element with respect to the visor, and vice versa.

In this way, given that the relative rotation of the shielding element with respect to the visor of the helmet is limited to a predefined angle, there is obtained a rotation of the visor and of the shielding element fixedly with respect to one another, in both of the directions of rotation of the two visors, when the angle of free relative rotation of the two visors is exceeded during actuation of the visors themselves. This enables the visor, or the shielding element, to be arranged in the position most appropriate for a subsequent actuation, when the shielding element, or respectively the visor, has already been rotated. In particular, for example, the lowering of the visor engaged with the front opening of the helmet can lead, by choosing appropriately the angle to which the relative rotation between visor and shielding element is limited, to the displacement of the shielding element itself in a position in which this, albeit not engaging the front opening of the helmet, can function as a flap and shield the user from sunlight or other atmospheric agents, remaining in any case easy to actuate by the user, since it is not excessively retracted with respect to the front opening.

According to a preferred aspect of the present invention, the visor is made of a material with high transmittance, i.e., transparent, and the shielding element consists of a visor equipped with a light filter not having high transmittance. Alternatively, the shielding element can be a flap for protection from the sun's rays and/or from atmospheric agents, such as for example rain.

In a preferred embodiment of the present invention, moreover, the shielding element is pivoted in correspondence to the same axis of rotation as that of the visor of the helmet and is set on the outside with respect to the visor.

The use of the same axis of rotation as that of the visor of the helmet and the fact that the shielding element is external with respect to the visor, leads to the shielding element possibly being advantageously and easily installed, optionally, on a helmet complete with an appropriate visor.

According to a particular aspect of the present invention, moreover, the aforesaid first means for limiting at a predefined angle, in both of the directions of rotation, the relative rotation of the shielding element with respect to the visor comprise a projection, or protrusion, integral to the shielding element, which engages in a slidable way within a seat, integral to the visor, equipped with two distinct end-of-travel arrests.

This is to say that the mere coupling of a projection, preferably in the form of a pin made of a single piece with the shielding element, with a seat, having the shape of an arc of a circle, made directly on the visor, enables the desired limitation at a predefined angle of the relative rotation of the shielding element with respect to the transparent visor to be readily obtained. The end positions of the seat having the shape of an arc of a circle, as will emerge evident also from the ensuing description, define the aforesaid end-of-travel arrests that enable mutual drawing-along of the visor and of the shielding element when the projection is resting on one of the ends and the user actuates the visor or the shielding element in the direction and sense in which the mutual engagement of the projection and of the end is maintained.

BRIEF DESCRIPTION OF THE DRAWINGS

In what follows, some embodiments of the helmet and of the set of visors according to the present invention will be described merely by way of non-limiting example, with reference to the attached figures, in which.

DETAILED DESCRIPTION OF THE INVENTION

Figure 1:
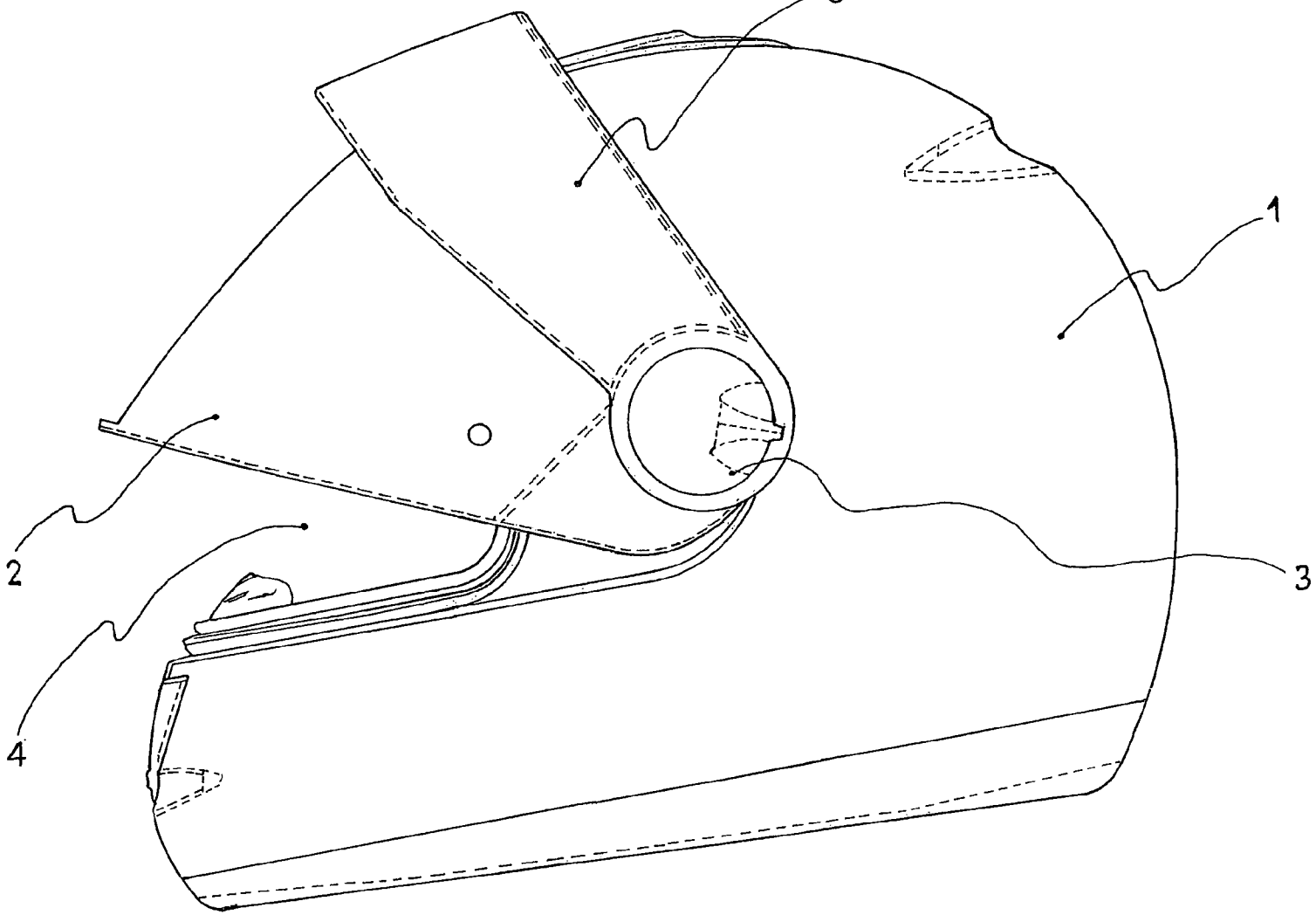
FIG. 1 is a side view of a safety helmet that can implement a set of visors according to the present invention.
Figure 2:
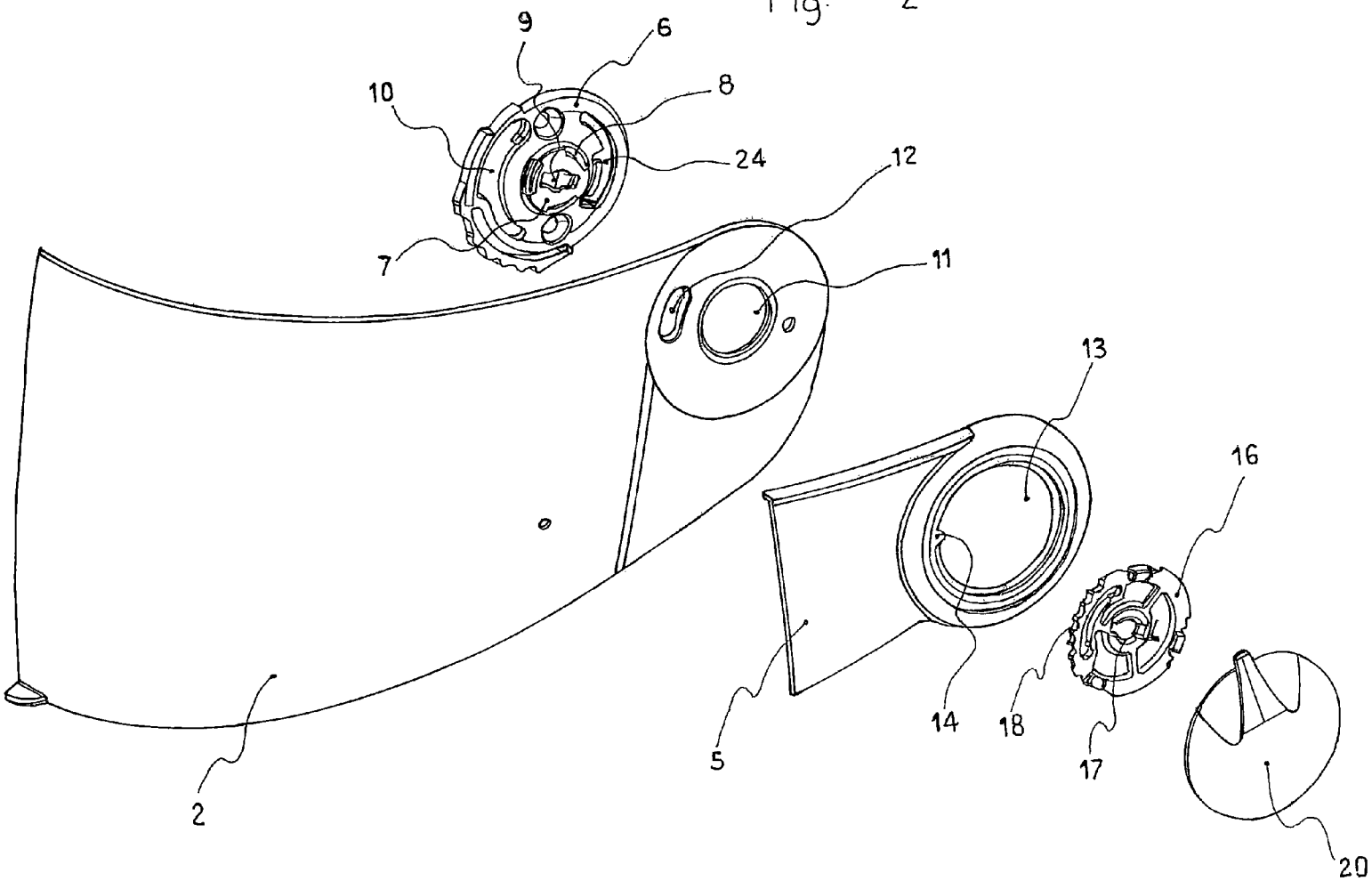
FIG. 2 is an exploded, partially cutaway, view from above of a set of visors for safety helmets according to a particular aspect of the present invention.
Figure 3:
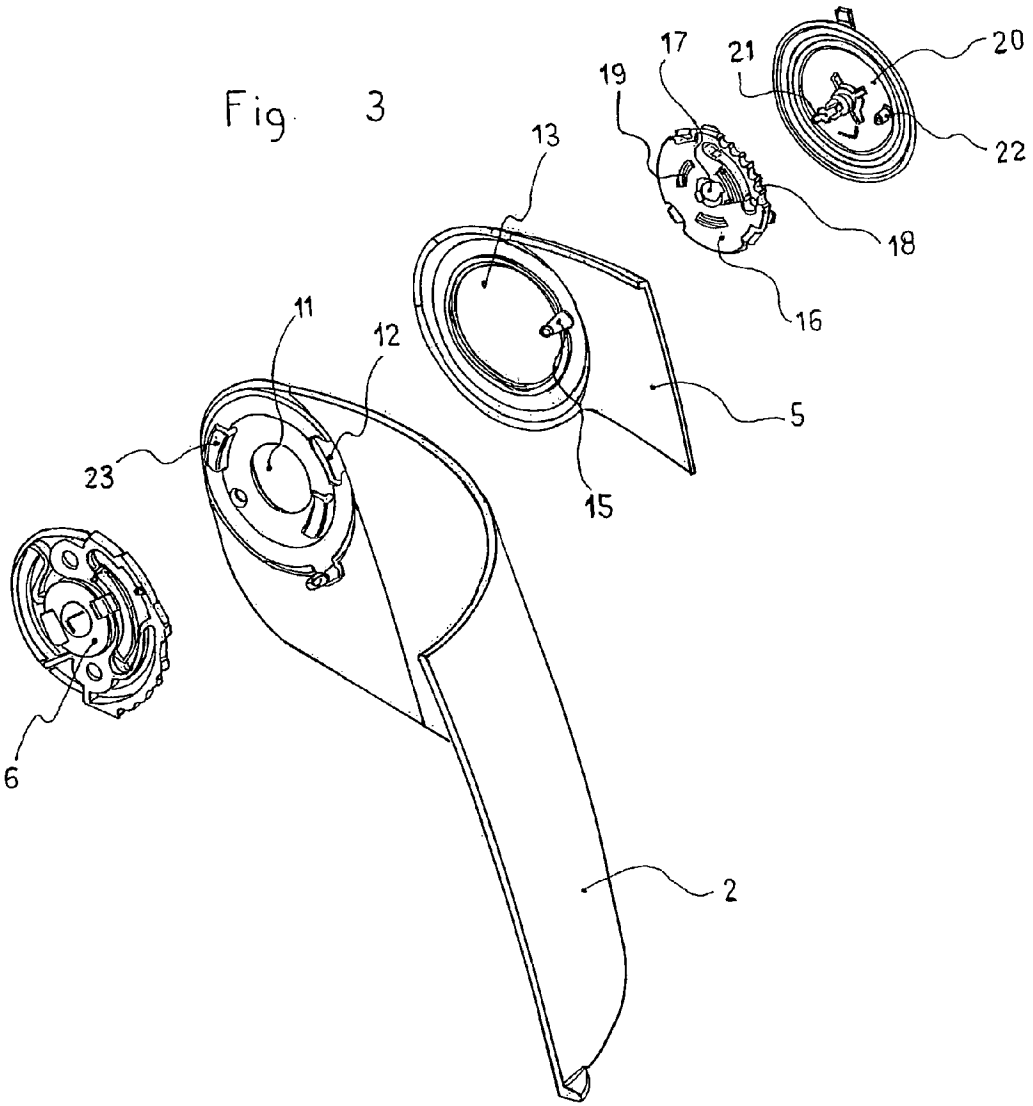
FIG. 3 is an exploded, partially cutaway, view from beneath of the same set of visors of FIG. 2.

In a preferred embodiment of the present invention, with reference to FIGS. 1 to 3, the safety helmet comprises a visor 2, generally transparent or in any case with high light transmittance, which is constrained in rotation to the cap 1 in a position corresponding to the sides 3 of the front opening 4 made in the cap 1 itself. The visor 2, according to the known art, can be rotated by the user, with respect to the cap 1, between a position of complete interception of the front opening 4 and a position raised with respect to the latter opening 4.

The helmet likewise comprises an element 5 for shielding from light rays (i.e., with reduced light transmittance), which is pivoted to the sides 3 of the opening 4 and can be rotated both with respect to the cap 1 and with respect to the visor 2. Preferably, the shielding element 5 is a supplementary visor, of smaller dimensions than the visor 2, equipped with filters for shielding from sunlight. As may be seen in FIG. 1, according to a preferred aspect of the present invention, the shielding element 5 is set above the transparent visor 2 in such a way as to enable direct actuation thereof by the user. Alternative arrangements of the shielding element 5 underneath the visor 2, such as, for example, the one described in the patent EP-A-0590255, can likewise be envisaged.

The visor 2, according to the known art, can be constrained to the cap 1 in a removable way by means of a mechanism comprising a base structure 6, fixed to the side area 3 of the cap 1, and equipped with housings or shaped seats 24 for one or more teeth for engagement 23 fixed to the visor 2 (see FIG. 3), a pin 7 for engaging a circular through hole 11 of the same visor 2, as well as means (not illustrated) to enable engagement or disengagement of the teeth 23 to/from the seats 24. The rotation of the visor 2 about the pin 7 enables the user to lower or rotate, with respect to the opening 4, the visor 2 during use of the safety helmet.

Alternatively, in embodiments that are not illustrated, the visor 2 can be pivoted at the sides 3 of the cap 1 in an irremovable way, for example via pins fixedly (integrally) projecting from the cap 1 itself, or yet again in a removable way, once again by similar known means, such as screws, pawls, etc.

The element or visor, for shielding 5, is also pivoted on the cap 1 at the sides 3 of the front opening 4, in such a way as to enable its rotation between a raised position disengaged from and a lowered position engaged with the front opening 4 of the helmet. In the latter position, the shielding element 5 is set in such a way as to constitute an effective, direct or indirect, protection from sunlight for the eyes of the user.

The shielding element 5, which is represented in the figures as a visor of small dimensions with low transmittance, may, for certain particular applications, be a so called "peak", consisting of a rotatable flap having the function of protecting the user from the sun's rays and/or from adverse weather conditions, such as, for example, rain. In particular, the rotatable flap can for example be shaped in such a way that the sun's rays do not reach, in the normal posture of use of the helmet, the region of the eyes of the user and in such a way that possible raindrops, which normally would fall on the surface of the transparent visor 2, fall instead on the shielding element 5, without consequently affecting the region delimited by the front opening 4 of the helmet 1.

In the embodiment illustrated in FIGS. 2 to 3, with evident advantages in terms of constructional simplicity, the shielding element 5 is pivoted along the same axis of rotation as the visor 2; i.e., the pins of the visor 2 and of the element 5 coincide, at least geometrically. However, it is possible to envisage other embodiments of the present invention in which the axes of rotation of the visor 2 and of the shielding element 5 do not coincide.

Figure 4:
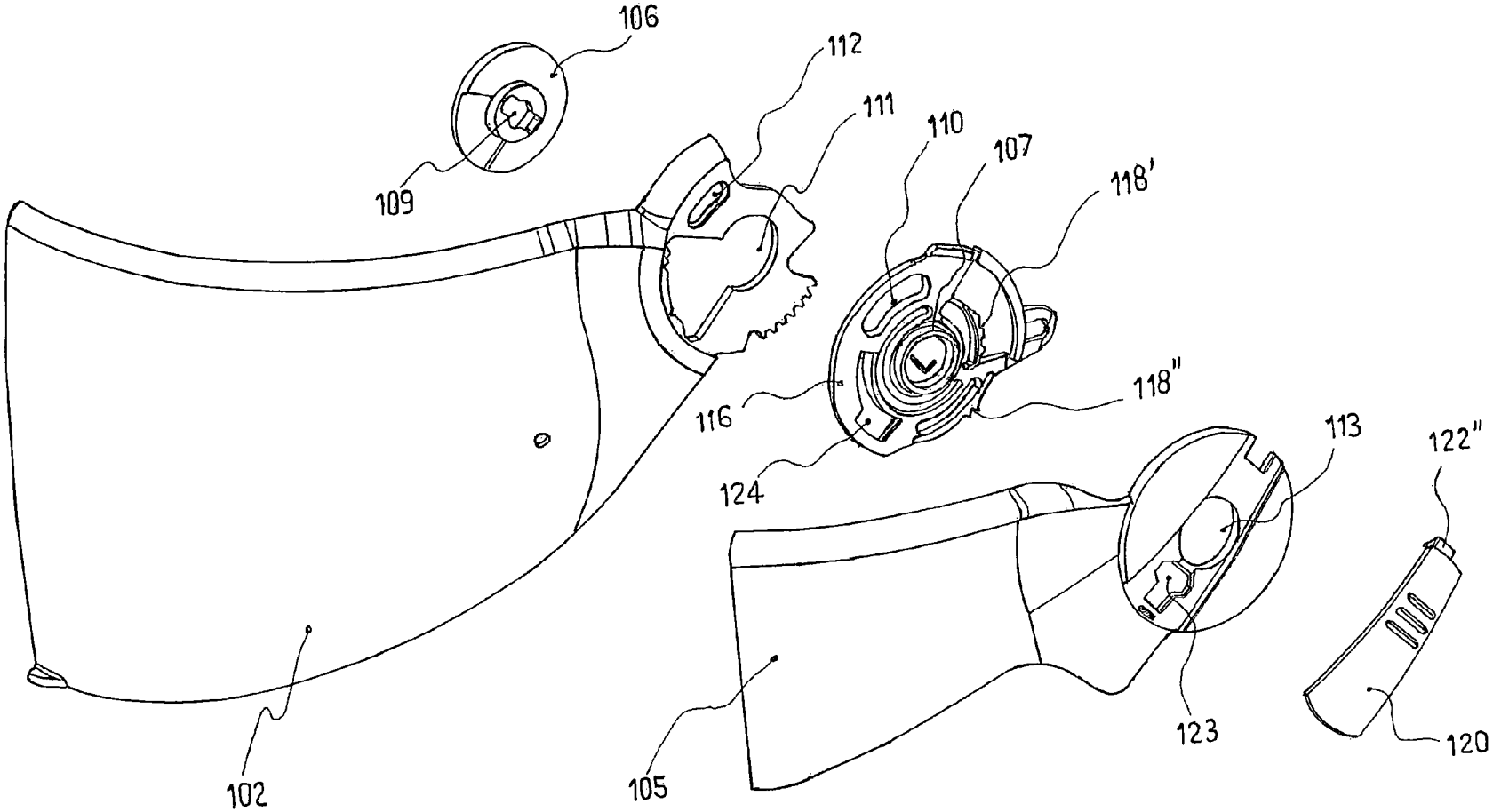
FIG. 4 is an exploded, partially cutaway, view from above, of a different set of visors for a safety helmet according to another aspect of the present invention.

In the embodiment of FIGS. 2-4, in particular, the shielding element 5 is fixed to the cap 1 by means of an engaging device 16, 20 designed to enable rotation of the element 5 with respect to the cap 1 along the same axis of rotation as that of the visor 2, and at the same time prevent sliding of the same element 5 along its axis of rotation, in recession from the cap 1. The engaging device 16, 20, in the particular embodiment illustrated in FIGS. 2 to 3, can be constrained removably to the appropriately provided base structure 6 of the mechanism for constraint of the visor 2 to the cap 1, in such a way that any relative displacement between the engaging device 16, 20 and the base structure 6 is prevented.

More in particular, the engaging device illustrated comprises a substantially cylindrical intermediate support 16, designed to enable rotation of the shielding element 5, and a retention cover 20, designed to constrain the support 1 6 and the element 5 to the base structure 6, and hence to the cap 1.

The intermediate support 16 is equipped, on its side surface, with at least one circular pivoting portion, on which there engages in a rotatable way a hole 13 of the shielding element 5, and with at least one circular toothed portion 18 designed to engage elastically with a detent 14 which, being fixed to the element 5, projects internally within the same hole 13. The engagement of the detent 14 with the toothed portion 18 of the support 16 enables rotation of the shielding element 5 with respect to the cap 1 for discrete angular intervals.

The intermediate support 16 likewise comprises, in a central position, a through hole 17 appropriately shaped to enable insertion of a fixing key 21, and, along its internal surface, contrast elements 19, which are designed to engage with the corresponding housings 8 provided on the pin 7 of the base structure 6.

The fixing key 21 is fixed to a cover 20 for axial retention of the shielding element 5 and projects from the internal wall of the cover 20. The cover 20 and the base structure 6 have a conformation and dimensions such as to prevent, once fixed to the cap 1, sliding in an axial direction, i.e., along the axis of relative rotation, of the shielding element 5.

In greater detail, the structure 6 comprises a housing 9, within which the fixing key 21 can be inserted, and a plurality of housings 8 made along the side wall of the pin 7, in which the contrast elements 19 of the intermediate support 16 are inserted. The housing 9 is shaped in such a way as to enable unobstructed sliding or axial retention of the key 21 according to the angle of relative rotation reached by the key 21 itself, and hence substantially brings about bayonet-like fixing of the cover 20.

The housings 8 may moreover be shaped and arranged along the side wall of the pin 7 in such a way as to function as centring elements for the intermediate support 16. As may be seen in the attached FIGS. 1 and 2, in fact, the presence of three housings 8, set at appropriate distances apart, can enable coupling, according to a relative pre-set arrangement, of the intermediate support 16 on the base structure 6 in such a way as to obtain centring of the through hole 17 with the housing 9.

Engagement of the projecting elements 19 within the recesses 8 of the base structure 6 prevents rotation of the intermediate support 16 with respect to the structure 6, whilst insertion and subsequent rotation, during closing, of the key 21 within the through hole 17 of the support 16 and within the housing 9 of the structure 6 prevents axial sliding of the cover 20 and hence of the support 16 itself with respect to the structure 6.

The safety helmet according to the present invention moreover advantageously comprises first means 12, 15 for limiting at a predefined angular interval, in both of the directions of rotation, the relative rotary displacement of the shielding element 5 with respect to the visor 2 in such a way that the shielding element 5 is rotatable in such a way that it is fixed to the visor 2 only when two distinct, and predetermined, relative positions of the element 5 with respect to the visor 2 are exceeded.

In this way, as has already been said, it is possible to prevent the element 5 from being set on the cap 1 in positions that are inconvenient to reach for the user or else to prevent actuation of the visor 2 engaged with the front opening 4 of the helmet from leading, albeit involuntarily, to simultaneous and undesired lowering of the shielding element 5 engaged with the opening 4.

In addition, on account of the possible different curvature of the visor 2 and of the shielding element 5, the presence of the aforesaid means for limiting, at a predefined angular interval, rotation of the element 5 with respect to the visor 2, prevents one edge, either a top one or a bottom one, of the shielding element 5 from possibly accidentally resting and sliding, perhaps following upon an erroneous radial thrust exerted by the user, on the visor 2, causing possible scratching or damage thereto.

In the preferred embodiment of the present invention, illustrated in FIGS. 2 and 3, the first means for limiting rotation of the shielding element 5 with respect to the visor 2 comprise a seat 12 having the shape of an arc of a circle and being equipped with two distinct end-of-travel positions, made on the visor 2, and a projection, or pin, 15 made of a single piece with or rendered fixed to the internal surface of the shielding element 5. The projection 15 engages, in a slidable way, within the circular seat 2 so that the relative rotation of the element 5 is limited by the two end-of-travel arrests of the seat 12.

It is of course possible to foresee a particular embodiment of the helmet according to the present invention, in which the seat 12 is made on the shielding element 5 and the projection 15 is fixed to the visor 2.

The seat 12 has a geometry such as to enable the shielding element 5, thanks to engagement of the projection 15, to be rotatable between a raised position with respect to the visor 2 and a lowered position of engagement with the top region of the visor 2 itself. Since the positions are relative to the visor 2, they are, in an absolute reference system, obviously dependent upon the position assumed by the visor 2 itself.

According to a peculiar aspect of the present invention, the safety helmet further envisages second means for limiting relative rotation of the shielding element 5 with respect to the cap 1, preferably constituted by a projection fixed to the shielding element 5, which is designed to engage in a seat 10, which is fixed, directly or indirectly, to the cap 1.

In the embodiment illustrated in FIGS. 2-3, the second means for limiting rotation of the element 5 with respect to the cap 1 are constituted by the projection 15 fixed to the shielding element 5, already used for limiting rotation of the element 5 with respect to the visor 2. which, exceeding the seat 12 made on the visor 2, likewise engages within a seat 10 of the seats 24 provided on the base structure 6 of the mechanism for constraint of the visor 2 to the cap 1, which is equipped with an appropriately shaped (i.e., elongated) area.

The dimensions of the seat 10, within which the projection 15 is inserted in a slidable way, are such as to impose two end-of-travel positions, one of complete opening and one of complete closing, for the visor 2 with respect to the cap 1, given the presence of the constraint between the projection 15 itself and the seat 12 made in the visor 2 itself. The seat 10 in fact enables the projection 15 to rotate, possibly together with the seat 12, only within the limits defined by the seat 10 and hence enables the shielding element 5 and the visor 2 to perform a rotation, possibly in a mutually integral way, limited to the angular interval defined by the seat 10 of the base structure 6.

In this way, thanks to the double constraint of the projection 15 within the seat 12 of the visor 2 and within a seat 10 of the seats 24 of the structure 6 and likewise thanks to the constraint of the teeth for engagement 23 within the same seats 10, the rotations of the visor 2 and of the shielding element 5 are in any case limited to a certain angular interval that facilitates actuation of the visor 2 and of the element 5 by the user.

Installation of the set of visors 2, 5, described above, on the safety helmet, envisages that, after the mechanism 6 has been mounted on the cap 1, in a position corresponding to the sides 3 of the front opening 4, and the visor 2 has been mounted on the mechanism 6, in a rotatable way, engaging the circular opening 11 on the pin 7, it will be necessary to fit the support 16 to the base structure 6, setting between the latter the shielding element 5.

In detail, the support 16 is coupled to the structure 6 in such a way that the projections 19 are engaged within the recesses 8 of the pin 7 and that the opening 13 of the element 5 will be rotatable on the side surface of the support 16 itself in such a way that the detent 14 will be engaged with the toothed portion 18, and the projection, or pin 15, passes with the circular seat 12 of the visor 2 and will likewise be engaged within an appropriately shaped seat 10 of the base structure 6.

The intermediate support 16 can moreover be shaped for being mounted by snap action within the shielding element 5 and thus be rotatable, with respect to the cap 1, integrally to the shielding element 5 itself.

Application of the cover 20 on the intermediate support 16, engaging the key 21 in the through hole 17 of the support 16 itself and in the housing 9 of the structure 6, and the subsequent rotation of the cover 20 to engage the key 21 in such a way as to prevent any axial sliding thereof, brings about simple fixing of the shielding element 5 to the safety helmet.

To remove the shielding element 5 described above, it is sufficient to rotate in the reverse direction the retention cover 20 so as to release the key 21 from the housing 9 of the base structure 6 and then slide out the key 21 both from the housing 9 and from the through hole 17 to enable removal of the cover 20 and hence of the support 16 and of the shielding element 15.

Figure 5:
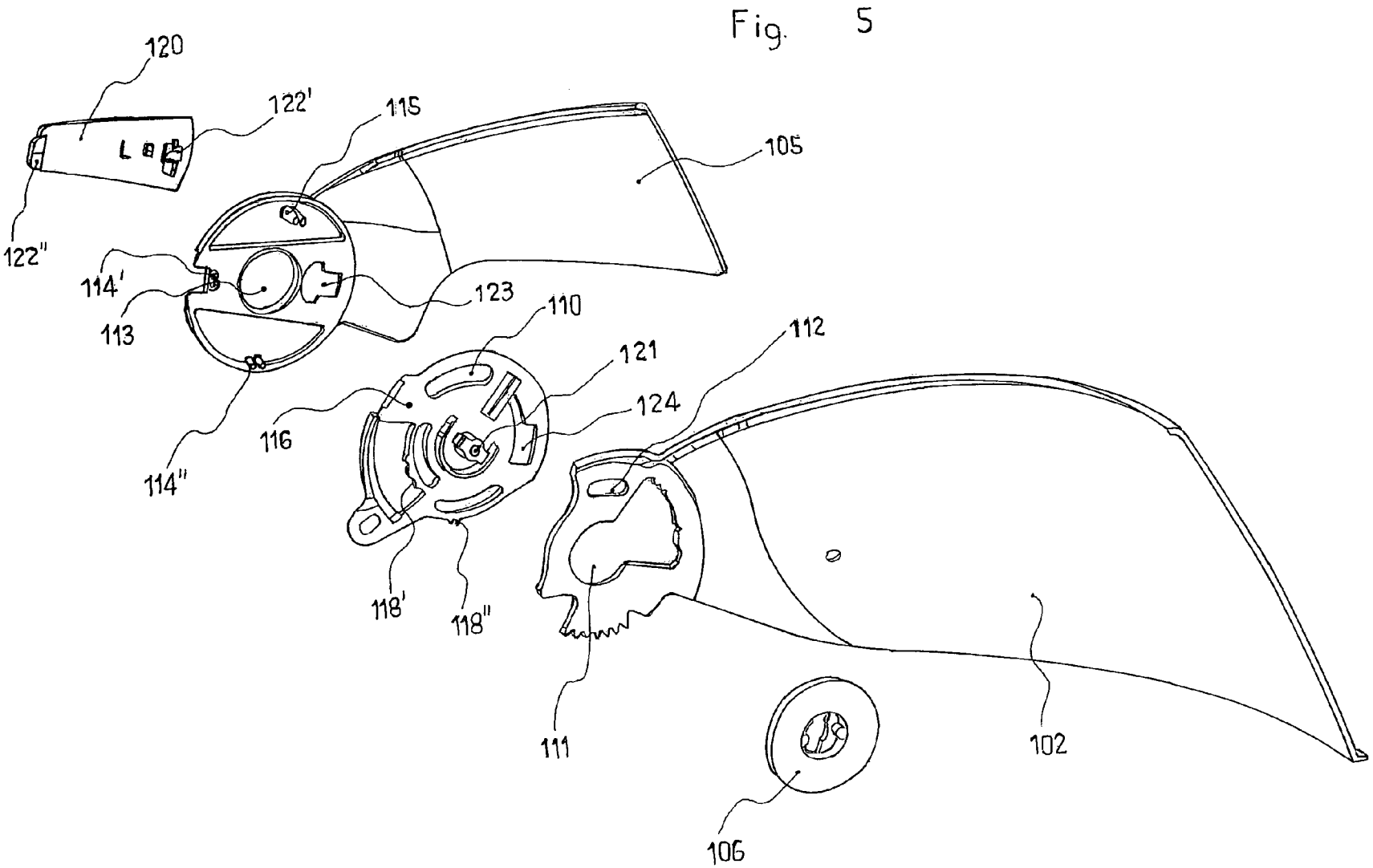
FIG. 5 is an exploded, partially cutaway, view from beneath, of the set of visors of FIG. 4.

With reference now to FIGS. 4 and 5, a system of visors for safety helmets is illustrated according to a further embodiment of the present invention.

The system of visors comprises, as in the case of the system of visors illustrated in FIGS. 2 and 3, an internal visor 102, made of a material with high transmittance, pivoted on the cap 1, at the sides 3 of the front opening 4, thanks to a pin 106 fixed to the cap 1 itself (not illustrated in FIGS. 4 and 5). The visor 102 rotates, as usual, between a raised position and a lowered position with respect to the opening 4, thanks to the engagement of its circular hole 111 on the pin 106. The visor 102, like the visor 2 of FIGS. 2 and 3, moreover comprises a seat having the shape of an arc of a circle, or eyelet, 112 set outside the circular hole 111 and extending for a delimited angular range.

The system of visors illustrated in FIGS. 4 and 5 likewise comprises a shielding element 105, preferably a visor with low transmittance, having smaller dimensions than those of the visor with high transmittance 102, which is set above the visor 102 and is also rotatable between a raised position of disengagement and a lowered position of engagement with the visor 102. The element 105 is pivoted, via an intermediate engaging support 116, to the cap 1 of the safety helmet in such a way that its axis of rotation will coincide with the axis of rotation of the visor 102.

In particular, the intermediate support 116 comprises an internal key 121 designed to engage with a housing 109, appropriately shaped, made on the pin 106 in such a way as to provide a bayonet-coupling fixing between the device 116 and the pin 106.

Between the support 116 and the pin 106 there is then set the visor 102, which is thus withheld in a rotatable way, but not axially slidable, by the fixed (integral) coupling of these components.

The intermediate support for engagement 116 further comprises a central pin 107 for engagement with a hole 113 of the element 105, a circular through seat 110, having the shape of an arc of a circle, and two toothed portions 118' and 118", which are also shaped like the arc of a circle. The toothed portions 118' and 118" are designed to engage elastically, according to the angle between the shielding element 105 and the support 116, with two detents 114' and 114" integral to the shielding element 105. Engagement of the detents 114' and 114" with the toothed portions 118' and 118" enables the shielding element 105 to reach only a discrete number of stable angular positions, with respect to the support 116, during its actuation in rotation.

A shaped plate 120, provided with internal teeth 122' and 122", likewise engages with the intermediate support 116 in such a way as to withhold the shielding element 105 constrained in a rotatable way, and not axially slidable, to the support 116 itself. In particular, the teeth 122' and 122" pass through the holes or seats 123 made on the shielding element 105 outside the through hole 113 and engage within elongated seats 124 made on the support 116. Sliding of the plate 120 in a direction transverse to the axis of rotation of the shielding element 105 brings about the removable constraint between the plate 120 itself and the support 116.

The system of visors 102, 105 described herein likewise envisages means for limiting, in both directions of rotation, at a predefined angular interval, the relative rotation of the element 105 with respect to the visor 102. The means, like the ones described with reference to FIGS. 2 and 3, comprise a projection, or pin, 115 made along the internal surface of the element 105, or rendered fixed thereto, and designed to engage with the through seat 110 of the device 116 and with the seat 112 of the visor 2. Constrained sliding of the projection fixed to the element 105 within the seat 112 of the visor 102 defines a corresponding limited rotation of the element 105 with respect to the visor 102 itself.

Engagement of the pin 115 within the seat 110 of the intermediate support 116 prevents the visor 102 and the shielding element 105 from possibly exceeding the end-of-travel positions defined precisely by the seat 110.

In both of the embodiments described above, the use of the set of visors for safety helmets, according to the present invention, envisages that, starting from an initial position, in which the visor 2; 102 and the shielding element 5; 105 are in a raised position with respect to the front opening 4 of the helmet, actuation of the visor 2; 102 with high transmittance by the user, engaged with the front opening 4 of the helmet, will bring about, thanks to the means 12, 15, 16; 112, 115, 116 for limitation of the rotation of the shielding element 5; 105 with respect to the visor 2; 102, simultaneous lowering of the shielding element 5; 105 towards the front opening 4. Thanks to the predefined arrangement and to the appropriate sizing of the means 12, 15, 16; 112, 115, 116, the simultaneous rotation (lowering) of the shielding element 5; 105 and of the visor 2; 102 starts only after the visor 2; 102 itself has undergone a first relative rotation with respect to the shielding element 5; 105, at angular extent defined by the means 12, 15; 112, 115, and in any case does not imply that the element 5; 105 will be set engaged to the visor 2; 102 to shield the eyes of the user, but rather leads to a favourable positioning of the element 5; 105 above the opening 4, which is readily accessible for the user.

Only a subsequent and voluntary actuation of the shielding element 5; 105 by the user, in rotation towards the front opening 4, and separately from the visor 2; 102, brings about lowering of the element 5; 105 with respect to the visor 2; 102 and thus protection of the eyes of the user.

Thanks to the toothed couplings 14; 18; 114, 118, it is likewise possible to limit rotation in lowering of the element 5; 105 in discrete and intermediate positions before arriving at complete closing thereof.

It should moreover be noted that this further rotation of the element 5; 105 is limited by the means 12, 15, 16; 112, 115, 116 in such a way that, in its final position of complete lowering, the element 5; 105 does not strike, in a position corresponding to its bottom edge, against the outer surface of the visor 2; 102.

Should the user then wish to raise the element 5; 105 to disengage it from the visor 2; 102, a first relative rotation of the element 5; 105 with respect to the visor 2; 102, enabled by the means of limitation 12, 15, 16; 112, 116, enables the disengagement. Any further undue rotation, in the direction of raising, of the element 5; 105 subsequently causes simultaneous raising of the visor 2; 102, without, however, leading to possible damage of the set of visors.

Should the user wish, instead, to raise the visor 2; 102, set in position of interception of the opening 4, regardless of the position assumed by the shielding element 5; 105, the consequent rotation of the visor 2; 102 causes, after a certain angular interval of free rotation, drawing along, due to the aforesaid means 12, 15, 16; 112, 115, 116, of the element 5; 105, which consequently does not require any prior raising. This consequently guarantees the user the possibility of restoring the maximum possible visibility at every moment and/or in every situation when travelling by acting directly and exclusively on the main visor 2; 102, without having to act also on the shielding element 5; 105.

Finally, the action of the means of limitation 12, 15, 16; 112, 115, 116, appropriately sized prevents raising of the underlying visor 2; 102 from possibly causing impact against the bottom edge of the overlying shielding element 5; 105, so causing possible scratching or cracking of the visor 2; 102.

In the final position, in which the visor 2; 102 and the shielding element 5; 105 are in a completely raised position with respect to the front opening 4 of the helmet, the intervention of the coupling between the pin 15; 115 with the end-of-travel arrest of the seat 10; 110 of the base structure 6 fixed to the cap 1 of the helmet, finally prevents any possibility of further rotation of the shielding element 5; 105 itself with respect to the cap and to the visor 2; 102. This guarantees that the element 5; 105 cannot proceed in its rotation until, for example, it comes into contact with the top or rear area of the cap itself, causing scratching thereof or other problems. The embodiments illustrated moreover enable, at any moment, disassembly of the shielding element 5; 105 from the helmet with extreme ease, without having to forgo use of the main visor 2; 102, which maintains all of its typical and original functional and protective characteristics unvaried.

The invention claimed is:

1. A safety helmet comprising a cap equipped with at least one visor, which is hinged to the cap at sides of a front opening of said cap and is rotatable between a position of interception of the front opening and a raised position with respect to said opening, and at least one light shielding element, which is also hinged to the cap at the sides of said front opening of the cap, said light shielding element being rotatable with respect to said cap, said at least one visor and said at least one light shielding element being independently rotatable one with respect to the other in both directions of rotation, only within a predefined angular interval, the rotation in both directions of said at least one visor not affecting, within the predefined angular interval of separate rotation, the displacement of said at least one light shielding element, and vice-versa, wherein said helmet comprises first means for allowing the joint rotation of said at least one visor and said at least one light shielding element when said predefined angular interval is exceeded in either one of both directions of rotation, said first means comprising at least one projection that engages in a slidable way within a seat, equipped with two distinct end-of-travel positions, said projection and said seat being respectively fixed to said at least one light shielding element and to said at least one visor, or vice-versa.

2. The safety helmet according to claim 1, comprising second means for limiting relative rotation of said at least one light shielding element with respect to said cap.

3. The helmet according to claim 2, wherein said second means for limiting the relative rotation comprise a second seat, provided with two distinct end-of-travel positions, within which at least one projection engages, said second seat being integral to the cap of the helmet and said projection being integral to said at least one light shielding element, or vice versa.

4. The helmet according to claim 3, wherein said at least one projection is integral to said at least one light shielding element and engages in said first seat integral to said at least one visor and simultaneously engages in said second seat integral to the cap of the helmet.

5. The helmet according to claim 1, wherein said at least one light shielding element is pivoted to the cap of the helmet in a position corresponding to the same axis along which said at least one visor is pivoted.

6. The helmet according to claim 1, wherein said at least one light shielding element is set outside said at least one visor with respect to the front opening of the helmet.

7. The helmet according to claim 1, wherein said at least one light shielding element is shaped for reaching, during its rotation, only a discrete number of stable positions with respect to the cap of the helmet.

8. A safety helmet comprising a cap equipped with at least one visor, which is hinged to the cap at sides of a front opening of said cap and is rotatable between a position of interception of the front opening and a raised position with respect to said opening, and at least one light shielding element, which is also hinged to the cap at the sides of said front opening of the cap, said light shielding element being rotatable with respect to said cap, said at least one visor and said at least one light shielding element being independently rotatable one with respect to the other in both directions of rotation, only within a predefined angular interval, wherein said helmet comprises first means for allowing the joint rotation of said at least one visor and said at least one light shielding element when said predefined angular interval is exceeded in either one of both directions of rotation, the helmet further comprising at least one base structure, integral to one side of the cap, that constrains in a rotatable way said at least one visor to the cap, and at least one engaging device that constrains in rotation said at least one light shielding element, said engaging device being removably constrained to said base structure, wherein said engaging device comprises an intermediate support, which is equipped with a surface of rotation for said at least one light shielding element and can be constrained to said base structure, and a retention cover, removably fixed to said intermediate support, to prevent axial sliding of said at least one light shielding element.

9. The safety helmet according to claim 8, wherein said retention cover is removably constrained to said base structure.

10. The safety helmet according to claim 8, wherein said at least one light shielding element comprises at least one detent that engages elastically in a toothed portion made on said engaging device, or vice versa, during relative rotation of said at least one light shielding element with respect to said engaging device.

11. The safety helmet according to claim 1, wherein said at least one light shielding element is a second visor equipped with at least one portion with low transmittance of light radiation.

12. The safety helmet according to claim 1, wherein said at least one light shielding element is a flap for protection from the sun's rays or from atmospheric agents.

13. A set of visors constrained laterally, in a rotatable way, to a cap of a safety helmet, the set of visors comprising at least one visor hinged to the cap at sides of a front opening of said cap and rotatable with respect to the cap, and at least one light shielding element also hinged to the cap at the sides of said front opening of the cap and rotatable with respect to the cap, said at least one visor and said at least one light shielding element being independently rotatable one with respect to the other in both directions of rotation, only within a predefined angular interval, the rotation in both directions of said at least one visor not affecting, within the predefined angular interval of separate rotation, the displacement of said at least one light shielding element, and vice-versa, wherein said set of visors comprises means for allowing the joint rotation of said at least one visor and said at least one light shielding element when said predefined angular interval is exceeded in either one of both directions of rotation, said allowing means comprising at least one projection that engages in a slidable way within a seat, equipped with two distinct end-of-travel positions, said projection and said seat being respectively fixed to said at least one light shielding element and to said at least one visor, or vice-versa.

14. The set of visors according to claim 13, comprising second means for limiting rotation of said at least one light shielding element with respect to the cap of the helmet.

15. The set of visors according to claim 13, wherein said at least one visor and said at least one light shielding element are pivoted laterally to the cap along one and the same axis.

16. The set of visors according to claim 13, wherein said at least one light shielding element is external with respect to said at least one visor.

17. The set of visors according to claim 13, wherein said at least one light shielding element is a visor equipped at least with an area with low transmittance of light rays.

18. The set of visors according to claim 13, wherein said at least one light shielding element is a rotatable flap for protection from light rays and/or from atmospheric agents.

* * * * *